US006796459B2

(12) United States Patent
Johnson

(10) Patent No.: US 6,796,459 B2
(45) Date of Patent: Sep. 28, 2004

(54) AUTOMATIC FILL SYSTEM FOR A BEVERAGE DISPENSER

(76) Inventor: Greg A. Johnson, 16002 Gridonhill Dr., Houston, TX (US) 77049

( * ) Notice: Subject to any disclaimer, the term of this patent is extended or adjusted under 35 U.S.C. 154(b) by 0 days.

(21) Appl. No.: 10/262,275

(22) Filed: Oct. 1, 2002

(65) Prior Publication Data

US 2003/0071055 A1 Apr. 17, 2003

Related U.S. Application Data

(63) Continuation of application No. 09/273,122, filed on Mar. 19, 1999, now abandoned.
(60) Provisional application No. 60/078,773, filed on Mar. 19, 1998.

(51) Int. Cl.[7] ..... B67D 5/08
(52) U.S. Cl. ..... 222/57; 222/66; 222/129.1
(58) Field of Search ..... 222/57, 66, 105, 222/129.1–129.4, 55

(56) References Cited

U.S. PATENT DOCUMENTS 3,528,587 A * 9/1970 Popinski ..... 222/56
4,407,431 A * 10/1983 Hutter, III ..... 222/1
4,728,005 A * 3/1988 Jacobs et al. ..... 222/64
4,795,061 A * 1/1989 Peckjian ..... 222/66
5,000,352 A * 3/1991 Cleland ..... 222/129.2
5,186,359 A * 2/1993 Brown et al. ..... 222/1
5,301,601 A * 4/1994 Cretors ..... 99/323.5
5,402,915 A * 4/1995 Hogan ..... 222/105
5,494,573 A * 2/1996 Schoenmeyr et al. ..... 210/94

* cited by examiner

*Primary Examiner*—Joseph A. Kaufman
(74) *Attorney, Agent, or Firm*—Nick A. Nickols, Jr.

(57) ABSTRACT

An automatic fill system for a beverage dispenser includes a sensor system for monitoring the beverage level in the dispenser. The sensors are wired in series with a level control board mounted inside the frame of the beverage dispenser. Sensing points are connected in an electrical circuit for maintaining the proper water to beverage concentrate ratio in the mixing hopper of the beverage dispenser. Resistance in the circuit is monitored so that when the resistance in the circuit reaches a predetermined value, a relay and solenoid open to divert water to the mixing hopper for mixing with the beverage concentrate. Sensors in the hopper shut off the dispenser when the beverage level in the hopper exceeds maximum and minimum levels.

7 Claims, 4 Drawing Sheets

AUTOMATIC FILL SYSTEM FOR A BEVERAGE DISPENSER

RELATED APPLICATIONS

This application claims the benefit of U.S. Provisional Application Ser. No. 60/078,773 filed on Mar. 19, 1998 and is a continuation application of U.S. patent application Ser. No. 09/273,122 filed Mar. 19, 1999, now abandoned.

BACKGROUND OF THE INVENTION

The present invention relates to a system for filling a beverage dispenser, and more particularly to an automatic batch fill system for a beverage dispenser for use with a single or dual beverage dispenser.

Equipment for dispensing beverage products such as margaritas, daiquiris, frozen lemonade, and frozen or semi-frozen fruit juices are well known in the prior art. Such devices vary from simple hand crank units used to make homemade ice cream to high capacity, high output cocktail freezers used by commercial establishments. Typically, these prior art beverage dispensers include a mixing cylinder having a beater bar mounted within the mixing cylinder. The beater bar is connected to a drive motor which rotates the beater bar within the mixing cylinder. A beverage retaining tank or hopper connected to the mixing cylinder holds the beverage mix or ingredients and delivers the beverage mix to the mixing cylinder through an opening or passageway connecting the retaining tank to the mixing cylinder.

The retaining tank must be periodically filled with new beverage ingredients when the beverage level in the retaining tank reaches a predetermined lower limit. The beverage ingredients are typically mixed with water at a specified ratio to form the beverage mixture. For example, a fruit juice beverage may be one part concentrated fruit juice and four parts water. Maintaining the proper ratio of fruit juice concentrate to water is critical to maintaining the consistency of the beverage from one batch to the next. While consistency of output of the beverage dispenser is very desireable, it is difficult to accomplish. Manual mixing of the beverage ingredients is subject to variation of the specified ratio between juice concentrate and water depending on the care taken to properly measure the beverage ingredients prior to mixing. A need, therefore, exists for a system which automatically fills a beverage dispenser and maintains the proper ratio of beverage ingredients between batches to deliver a consistent product.

SUMMARY OF THE INVENTION

The automatic batch fill system of the invention incorporates a sensor system for monitoring the beverage level in the dispenser. The sensors are wired in series with a level control board, product out hose sensing point, chassis ground and a level control board mounted inside the frame of the beverage dispenser. The system of the invention includes sensing points connected in an electrical circuit for maintaining the proper water to beverage concentrate ratio in the mixing hopper of the beverage dispenser. Resistance in the circuit is monitored so that when the resistance in the circuit reaches a predetermined value, a relay and solenoid open to divert water to the mixing hopper for mixing with the beverage concentrate. Sensors in the hopper shut off the dispenser when the beverage level in the hopper exceeds maximum and minimum levels.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
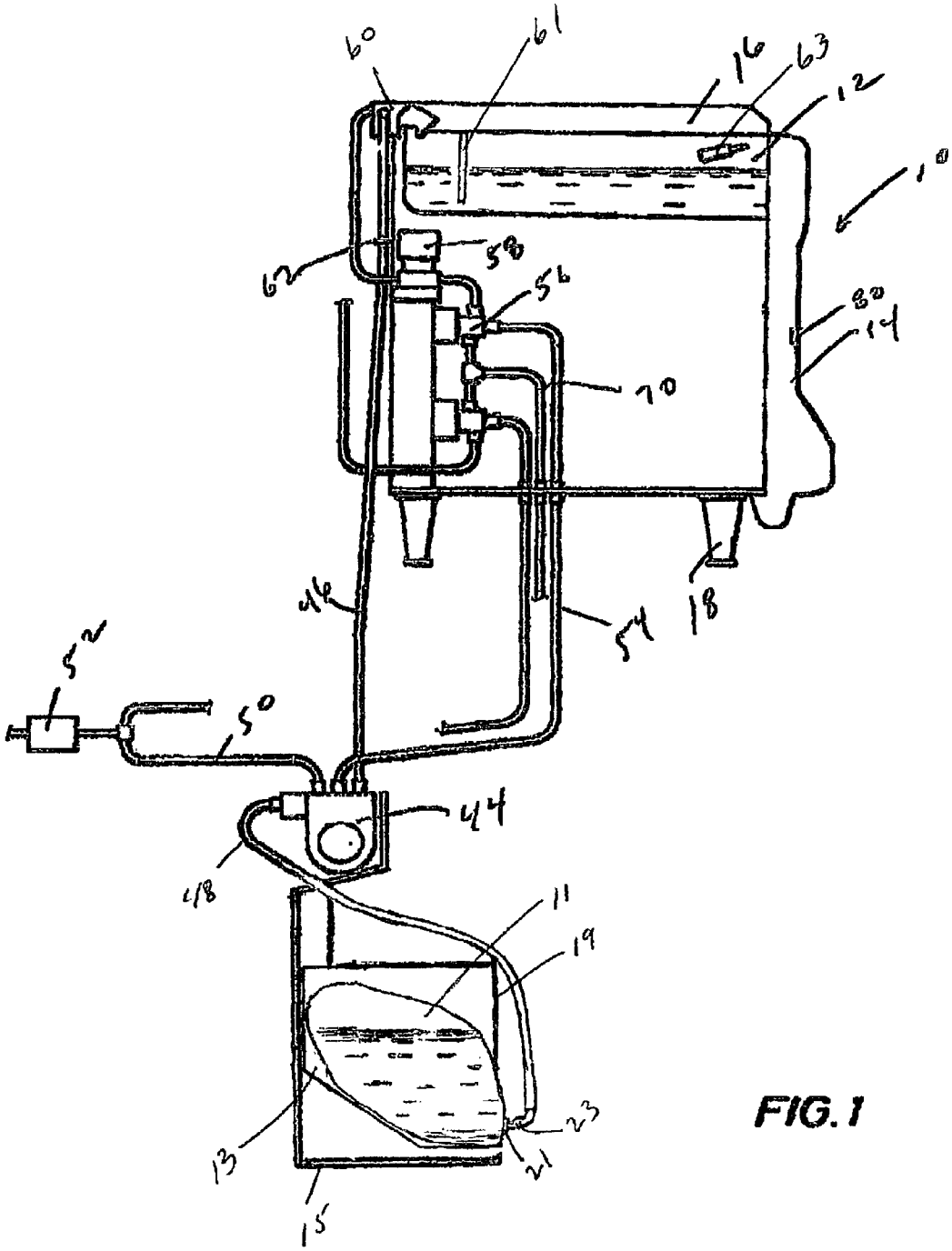
FIG. 1 is a diagram and partial section view of the components of the automatic fill system of the invention.

A preferred embodiment of the automatic batch fill system for a beverage dispenser in accordance with the present invention is illustrated in FIG. 1. In the preferred embodiment of the invention, the beverage dispenser, generally identified by the reference numeral 10, includes two separate refrigeration systems and a mixing hopper 12 for each refrigeration system mounted in the upper portion of the dispenser 10. A separate batch fill system is connected to each of the mixing hoppers 12. It is understood however, that the batch fill system of the invention may be used with beverage dispensers having a single refrigeration system and one mixing hopper 12.

The beverage dispenser 10 includes a housing or cabinet having side walls, a bottom, and front and rear walls. The front wall of the dispenser housing is enclosed by a front panel 14. The top of the beverage dispenser 10 is closed by a removable cover 16. The beverage dispenser 10 includes adjustable support feet 18 located adjacent each corner of the dispenser housing.

Mounted within the dispenser housing 10, but not shown in the drawings, are two closed loop refrigeration systems comprising a compressor, a heat exchanger, a filter/dryer and a condenser. For the sake of clarity, only one of the refrigeration systems of the invention will be described herein, it being understood that both refrigeration systems of the invention are identical. A mixing cylinder which is in fluid communication with the hopper 12 is mounted within the dispenser housing. The forward end of the mixing cylinder extends through an opening in the front wall of the dispenser housing. A faceplate covers the forward end of the mixing cylinder and includes a dispensing nozzle extending therefrom for dispensing the beverage. By way of example, but not intended as in any way limiting the use of the batch fill system of the invention, the dispenser 10 is particularly adapted for dispensing semi-frozen fruit juice beverages.

Referring still to FIG. 1, the fill system of the invention includes a reservoir 11 for the beverage concentrate. The concentrate reservoir 11, as best shown in FIG. 1, comprises a bag supported in a bag tray 13. The bag tray 13 is mounted to a base 15, which may be remotely located from the beverage dispenser 10. The bag tray 13 is open at the top and includes an opening 17 in the front wall 19 thereof so that the bag cap 21 of the concentrate bag 11 is accessible for connection to a dispensing connector 23.

Figure 7:
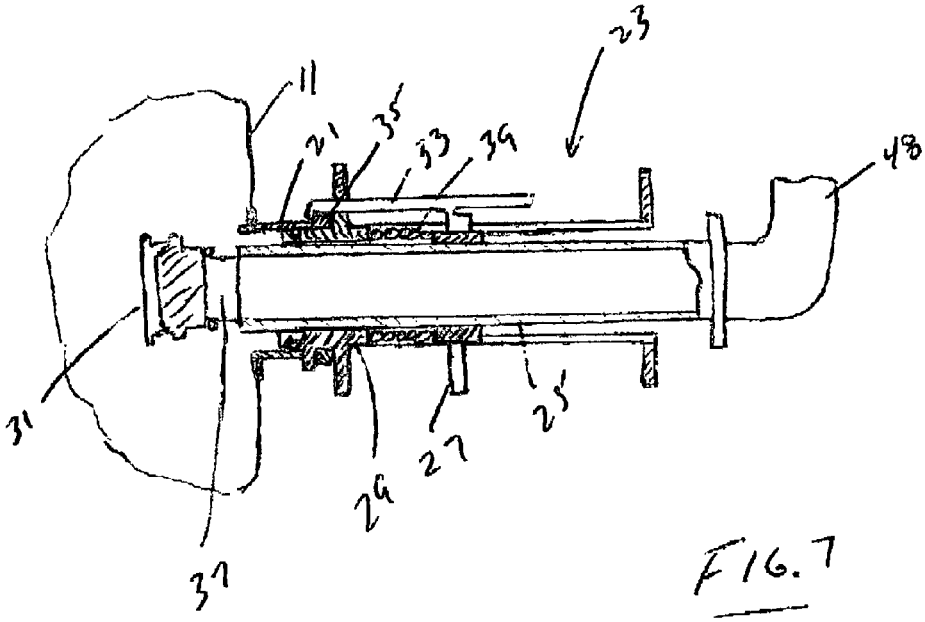
FIG. 7 is a section view of the dispensing bag connector of the invention.

The connector 23 is shown in greater detail in FIG. 7. The concentrate bag 11 is sealed and access is provide through the bag cap 21. In the position shown in FIG. 7, the connector is connected to the bag cap 21 with the plunger 25 extending into the bag 11. Initially however, the plunger 25 is retracted by pulling back on the thumb depressor 27 which is fixedly secured on the external surface of the plunger 25. In this position, the forward end of the guide cage 29 slides sideways onto the cap 21 until it snaps in place. The thumb depressor 27 is then pressed forward to advance the plunger 25 into the bag cap 21 so that the distal end of the plunger 25 frictionally engages the seal cap 31 and disengages it from the bag cap 21. When the plunger 25 is fully depressed into the bag cap 21, the connector lock 33 carried by the thumb depressor 27 locks over the circumferential lip 35 of the bag cap 21, thereby locking the plunger 25 in its fully extended position so that the beverage concentrate may flow through the transverse hole 37 of the hollow plunger 25 providing a passage way for the beverage concentrate through the connector 23.

The connector 23 is easily disconnected from the bag cap 21 by pressing down on the end of the connector lock 33 to disengage it from the bag cap 21. The thumb depressor is then pulled back to retract the plunger 25 from the bag 11. A spring 39 journalled about the plunger 25 between opposed shoulders of the thumb depressor 27 and guide cage 29 retains the plunger 25 in a retracted position. As the plunger retracts out of the bag cap 21, the seal cap 31 is re-engaged with the end of the bag cap 21. The guide cage 29 may then be slid off of the bag cap 21.

Referring again to FIG. 1, a pump 44 pumps the beverage concentrate to the hopper 12 via a fluid line 46. A fluid line 48 connects the beverage concentrate bag 11 to the pump 44. The pump 44 is also connected to a water supply by supply line 50. A water pressure reducer 52 is incorporated in the supply line 50 to regulate water pressure directed to the pump 44. A fluid line 54 connects the water side of the pump 44 to a three way valve 56, which in turn is connected to a solenoid valve 58 which directs water to the water side of the blending blocks 60 which are mounted on the rear panel of the dispenser 10 for directing a mixture of water and beverage concentrate into the hopper 12.

Figure 3:
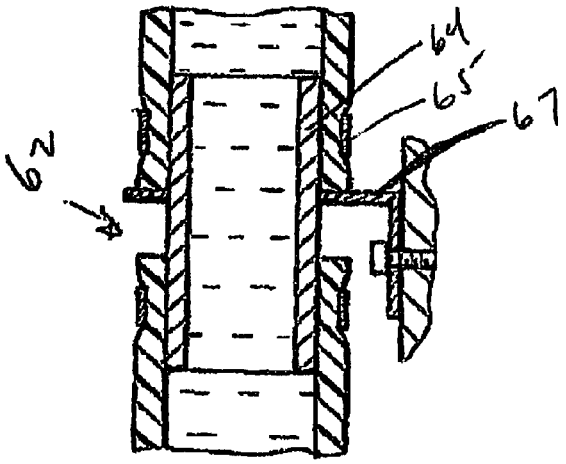
FIG. 3 is a partial section view of splice sleeve sensor of the invention.

The beverage level in the hopper 12 is monitored by sensors 61 and 63 mounted in the hopper 12 as shown in FIG. 1. The sensors of the invention are wired in series with a level control board, a splice sensor in the concentrate flow line 46, chassis ground and a level control board (not shown in the drawings) mounted inside the dispenser housing 10. The hose splice sensor 62 incorporated in the concentrate flow line 46 is shown in greater detail in FIG. 3. The sensor 62 comprises a metal sleeve 64 inserted to join the ends of the flow line 46 which is cut near the blending blocks 60. The sleeve 64 is secured to the cut ends of the line 46 by clamp rings 65 and secured to the back panel of the dispenser 20 by a bracket 67.

Figure 2:
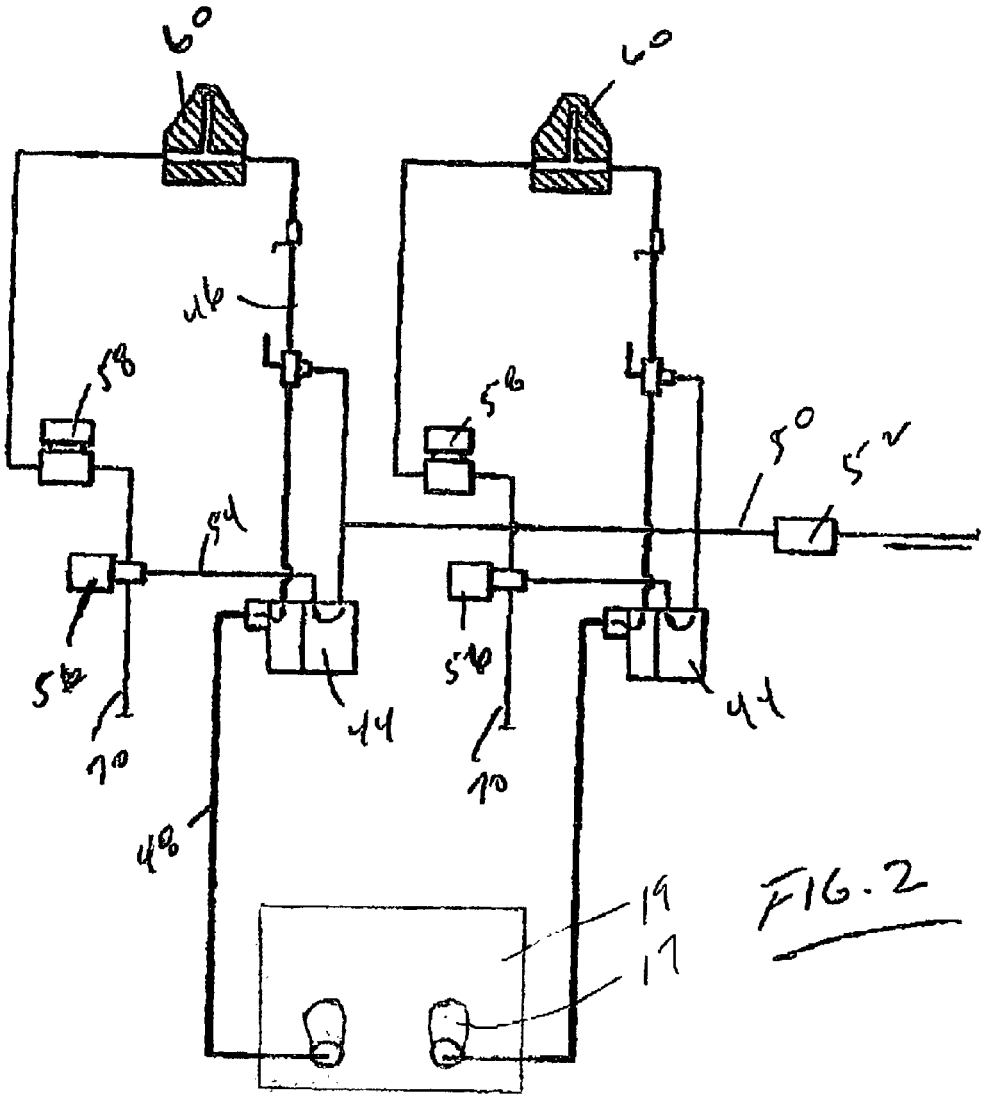
FIG. 2 is a flow diagram and partial cross section depicting the concentrate reservoir fluid flow path of the fill system of the invention.

There is one sensor system for each hopper 12 of the dispenser 10 as shown in the flow diagram of FIG. 2. When the sensor system of the invention is primed and the concentrate flow line 46 is completely filled to the blending block 60 sensing point, the resistance in the sensor circuit is equal to or less than the potentiometer setting on the level control board. When this happens, the relay and solenoid valves 56 and 58 are actuated to close the drain line 70 and divert water to the blending block 60 for mixing with the beverage concentrate at a specified ratio, for example, a 4:1 ratio (four parts water and one part concentrate).When the sensor circuit resistance level is not met, an indication that the concentrate flow line is not full to the blending block 60 sensing point, water is diverted through the drain line 70 so as not to introduce water without concentrate into the hopper 12.

A timer circuit which is adjustable from 1–100 seconds controls the cycle of the pump 44. When the beverage concentrate level in the hopper 12 drops below the low level sensor 61, the circuit continuity breaks causing the pump 44 to shut down and an audible and/or visible indicator alerts the operator that the bag 11 is empty. The empty concentrate bag 11 is replaced with a full bag. The system is then primed by actuating a priming button or switch on the front panel of the dispenser 10 until the resistance in the sensor circuit achieves the setting of the level control board and the pump 44 again cycles dispensing the water/concentrate mixture into the hopper 12.

Referring again to FIG. 1, in the event the water/concentrate level in the hopper 12 rises to an overflow condition, the sensor 63, which may be a float type sensor, is activated and shuts down all power to the dispenser and pump controls. Draining the hopper 12 slightly returns the sensor 63 to its original position, thereby permitting the pumping and dispenser operation to resume.

Figure 4:
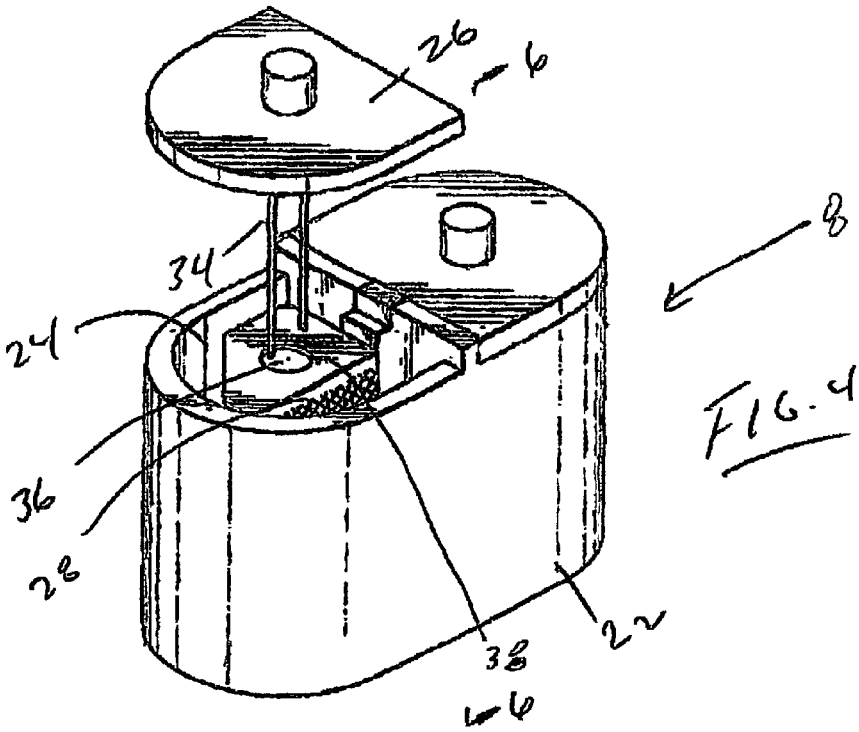
FIG. 4 is a perspective view of an alternate embodiment of the beverage concentrate reservoir of the invention.
Figure 5:
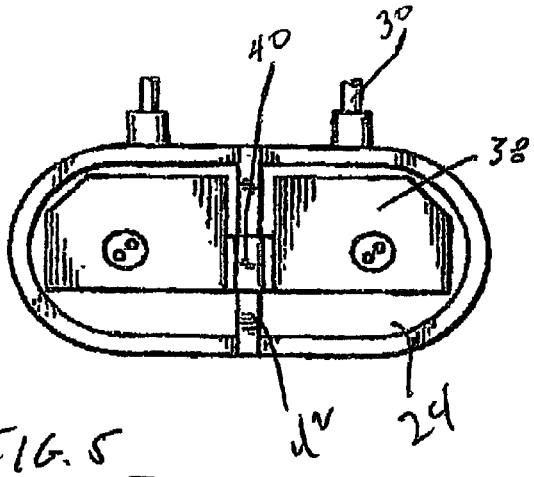
FIG. 5 is a partial top view of the beverage concentrate reservoir of the invention shown in FIG. 4.
Figure 6:
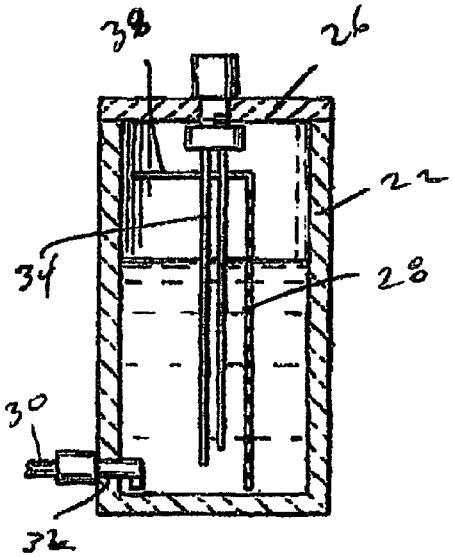
FIG. 6 is a section view of the beverage concentrate reservoir of the invention taken along line 6—6 of FIG. 4.

Referring now to FIGS. 4–6, an alternate embodiment of the beverage concentrate reservoir of the invention is shown. The reservoir 8, as best shown in FIG. 4, may be substituted for the concentrate bag 11 by removing the bag tray 13 and mounting the reservoir 8 on the base 15. The reservoir 8 includes a body 22 which is divided into two chambers 24. The chambers 24 are open at the top ends thereof. The open ends of the chambers 24 are closed by lids 26.

The chambers 24 are further subdivided by pulp strainers 28 so that each chamber 24 is partitioned into a front and back portion. The strainers 28 extend across the chambers 24. The chambers 24 are filled by pouring a beverage concentrate, such as a fruit concentrate, into the front area or portion of the chamber 24. Any fruit pulp or large particles which may be in the fruit concentrate are filtered by the strainers 28 and retained in the front area of the chamber 24. Concentrate in the chambers 24 is removed from the back portion of the chambers 24 through hoses 30 connected to outlet ports 32.

Referring now collectively to FIGS. 4 and 6, the lids 26 includes probes 34 projecting downwardly threrefrom and extending through openings 36 formed in a transverse flange 38 of the strainers 28. A bridge member 40 which extends over and is supported on the partition wall 42 connects the strainers 28 as shown in FIG. 5. The probes 34 extend through the flanges 38 into the back portion of the chambers 24.

The probes 34 are wired in series with the level control board housed within the dispenser 10 discussed above. The sensor system of the embodiment of the invention shown in FIGS. 4–6 operates similar to the description provided heretofore relating to the bag reservoir 11. However, when both probes 34 in the reservoir 8 are covered with concentrate and the hose 46 is completely filled with concentrate to the blocks 60, the resistance in the circuit is equal to or less than the potentiometer setting on the level control board.

Under these conditions, as previously described, the relay and solenoid valves 56 and 58 open and water is diverted to the blending blocks 60 and mixed with the fruit concentrate at the specified ratio and dispensed into the hopper 12. However, until the resistance level in the circuit is met, water from the water supply is diverted to drain through the drain line 70 so as not to introduce water into the hopper 12 without the beverage concentrate.

When the concentrate level in the reservoir 8 falls below the probes 34, the fill system of the invention shuts down the dispenser and provides a signal to the operator that concentrate needs to be added. When the reservoir 8 is filled, a fill button 80 located on the front panel of the dispenser 10 is held down to start the pump 44 which will run for the selected time. The length of the probes 34 and product pickup point in the reservoir 8 are designed to shut down the pump 44 before any air is introduced into the product hoses 46 and 48 so that the product hoses remain full and the system primed. In the event air enters the product hoses 46 and 48, the system may be primed by holding down a priming button until the sensor circuit resistance is met and the pump 44 cycles to pump the specified ratio of water/concentrate into the hopper 12.

While a preferred embodiment of the invention has been shown and described, other and further embodiments of the invention may be devised without departing from the basic scope thereof, and the scope thereof is determined by the claims which follow.

What is claimed is:

1. An automatic fill system for a beverage dispenser, comprising:

a) a beverage concentrate reservoir in fluid communication with a beverage mixing hopper mounted in the beverage dispenser;

b) means for pumping water and beverage concentrate at a selected ratio into the mixing hopper of the beverage dispenser;

c) means for monitoring the beverage level in the mixing hopper and automatically turning off said pump means upon exceeding a minimum or maximum beverage level;

d) a blending block in fluid communication with a water source and said beverage concentrate reservoir;

e) means for diverting water to a drain line upon interruption of the flow of beverage concentrate to said blending block; and f) a beverage concentrate sensor secured in a beverage concentrate flow line connecting said blending block to said beverage concentrate reservoir.

2. The fill system of claim 1 wherein said monitoring means includes a pair of sensors mounted in said mixing hopper for sensing the level of the beverage in said mixing hopper.

3. The fill system of claim 1 wherein said diverting means includes a three-way valve and a solenoid valve electrically connected to said monitoring means.

4. The fill system of claim 1 wherein said fluid ratio is 4:1, four parts water and one part concentrate.

5. The fill system of claim 1 including a second blending block for directing water and concentrate into a second mixing hopper.

6. The fill system of claim 1 wherein said beverage reservoir comprises a beverage concentrate bag supported in a bag tray mounted to a base.

7. The fill system of claim 1 including at least two sensors mounted in the mixing hopper for monitoring maximum and minimum levels of the beverage in the mixing hopper.

* * * * *